United States Patent [19]

Sutter

[11] 4,422,272

[45] Dec. 27, 1983

[54] COSMETIC COVER FOR CHANNELLED TYPE GRID SYSTEMS

[75] Inventor: Ormond Sutter, Placentia, Calif.

[73] Assignee: Lok Products Company, Fullerton, Calif.

[21] Appl. No.: 212,982

[22] Filed: Dec. 4, 1980

[51] Int. Cl.[3] ..... E04B 5/52

[52] U.S. Cl. ..... 52/311; 52/475; 52/666

[58] Field of Search ..... 52/664, 668, 484, 475, 52/144, 665, 311, 717, 232, 667, 666; 403/230, 347

[56] References Cited

U.S. PATENT DOCUMENTS

| | | | |
|---|---|---|---|
| 2,191,161 | 2/1940 | Romanoff | 52/668 |
| 2,199,244 | 4/1940 | Mulford | 52/668 |
| 3,350,125 | 10/1967 | Adams | 403/28 |
| 3,378,976 | 4/1968 | Meredith, Jr. | 52/573 |
| 3,590,544 | 7/1971 | Shepherd | 52/293 |
| 3,675,957 | 7/1972 | Lickliter | 403/252 |
| 3,748,998 | 7/1973 | Lambert | 98/40 D |
| 3,782,055 | 1/1974 | Spencer et al. | 403/28 |
| 4,019,300 | 4/1977 | Saver et al. | 52/665 |
| 4,021,986 | 5/1977 | McCall | 52/475 |
| 4,115,970 | 9/1978 | Weinar | 52/311 |
| 4,157,000 | 6/1979 | Sutter | 52/489 |
| 4,272,937 | 6/1981 | Brugman | 52/665 |

OTHER PUBLICATIONS

Accent Integrated Ceiling Systems Brochure.
Trend Pacific Acoustics, Inc.

*Primary Examiner*—John E. Murtagh
*Attorney, Agent, or Firm*—Lyon & Lyon

[57] ABSTRACT

Ceiling grid system using support members and intersecting transverse members obtain a through appearance without slotting the support members by use of a cosmetic cover member at the intersection of a support member and a transverse member.

2 Claims, 4 Drawing Figures

FIG. 1.
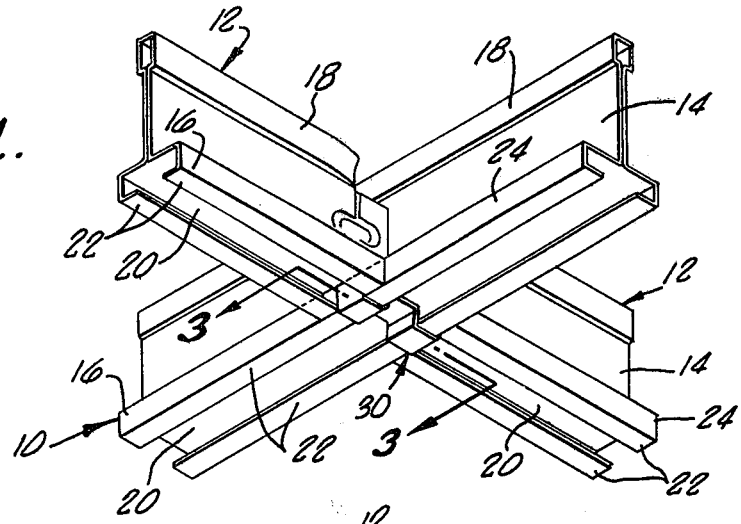
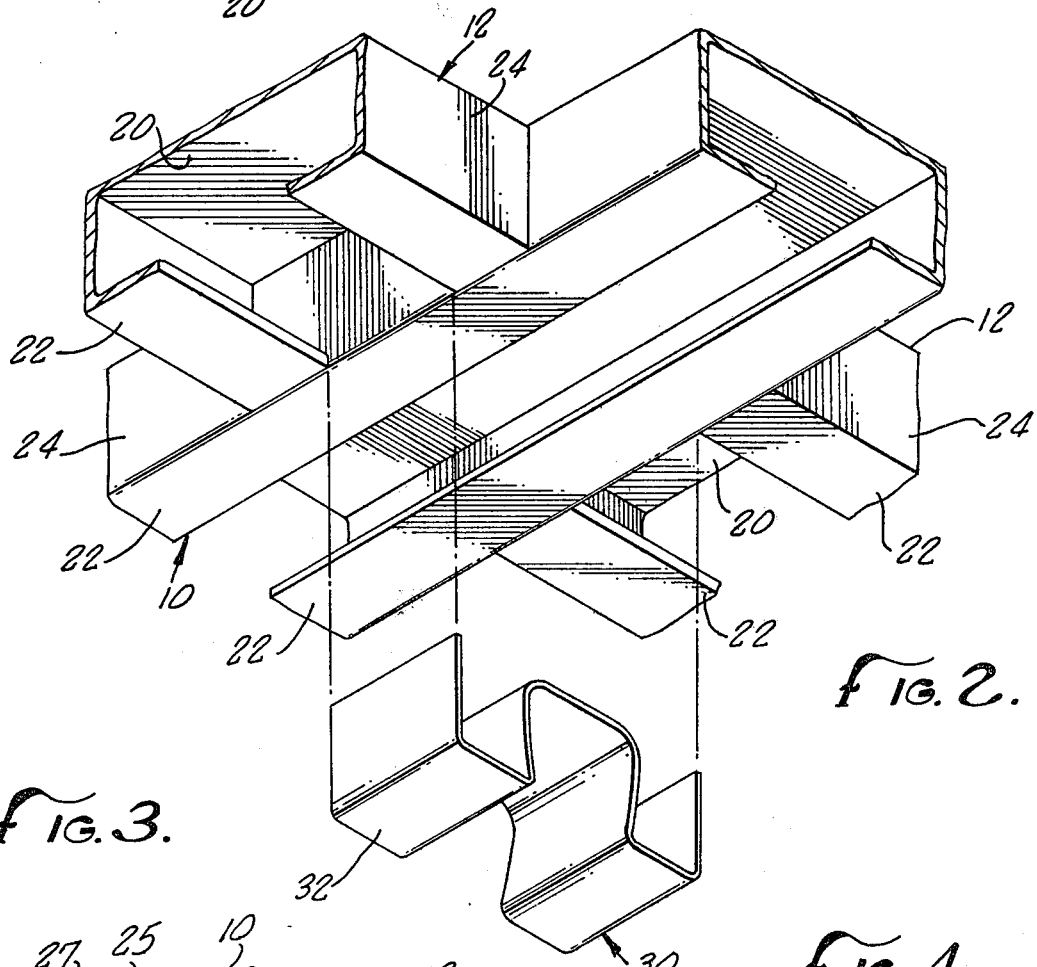
FIG. 2.
FIG. 3.
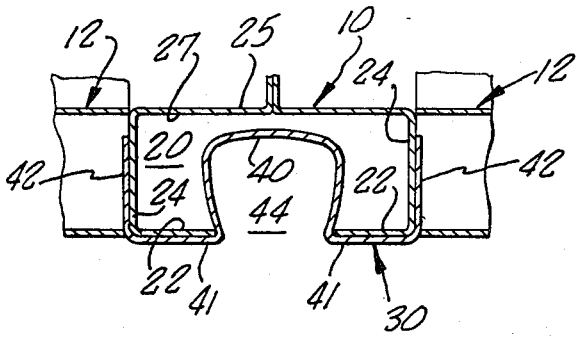
FIG. 4.
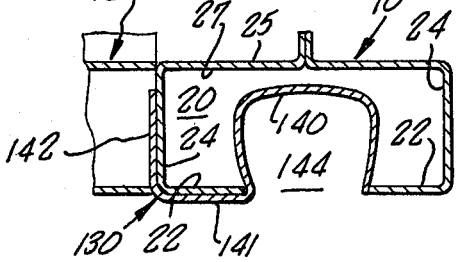

COSMETIC COVER FOR CHANNELLED TYPE GRID SYSTEMS

BACKGROUND

This invention relates to traversely interlocking structural members which form a grid system.

Grid systems for supporting a plurality of individual panel members in the same plane are well known. Such systems are used for example, for suspended ceilings in many types of buildings. Such grid systems are described in U.S. Pat. Nos. 3,350,125; 3,378,976; 3,590,544; 3,675,957; 3,748,998; 3,782,055; 4,019,300; and 4,157,000.

In one type of installation, the grid system comprises a support member and a pair of opposing transverse members intersecting with and abutting against the support member. In addition, the support members can be intersected by a single transverse member such as proximate to a lighting fixture. The support members and transverse members have a similar configuration, each comprising a vertical web and a lower support channel. The support channel comprises a downward facing groove of a first color and a downward facing flat on either side of the groove. The flat is of a second color that contracts with the first color.

With this configuration, there can be an appearance problem. Namely, at the intersection of the support members with the transverse members, the color of the downward facing groove of the transverse members is not continuous, the grooves of opposing transverse members being spaced apart by the flats of the support member.

One solution to this appearance problem is to place a notch on the support member at the locations at which it is contacted by opposing transverse members. However, there are serious problems with using a notch. For example, it substantially reduces the load carrying capacity of the support member. Further, forming a notch in the support member greatly decreases the rate at which the support member can be manufactured, thereby resulting in a substantial increase in the cost of production for the support member.

Another disadvantage of using a notch is that there is no flexibility in locating lighting fixtures and the like in the ceiling grid structure. The preformed notch results in preordained location of lighting fixtures and the like. With grid systems where the support member is not notched, the transverse member can intersect the support member whenever the vertical web of the support member has a slot.

In view of these problems, it is apparent that there is need for a ceiling grid structure which retains the attractive appearance of the contrasting colors of the groove and the flats, but which also dispenses with notched support members and the disadvantages associated therewith, and which allow transverse members to intersect a support member wherever a prepunched slot is located.

SUMMARY

The present invention is directed towards a channelled ceiling grid system that has these features. The system comprises a support member and a pair of opposing transverse members intersecting with and abutting against the support member. The support members of the system can also be intersected by a single transverse member. The support member and the transverse members are of similar configuration, each comprising a vertical web and a lower support channel. The support channel comprises a downward facing groove having a downward facing interior wall of a first color and downward facing flats of a second color on either side of the groove. Means for connecting each transverse member to the support member, such as a stab-in or clip connection, are provided. The support member is not notched at the point of intersection. In order to maintain the attractive appearance of the contrasting first and second colors, a cover member is provided. The cover member is adapted to engage the support member and cover the flats of the support member at the location the support member is intersected by the transverse members. The downwardly facing surface of the cover member is of the first color so that the appearance of the two opposing transverse members inn combination with the cover member is that of a single continuous member. A first type of cover member is provided for locations where the support member is intersected by an opposing pair of transverse members and a second type of cover member is provided for locations where the support member is intersected only by a single transverse member.

Preferably both types of cover members comprise a resilient clip that engages the groove and flats of the support member. For example, the first type of cover member can be a clip comprising two exterior upwardly extending arms and an interior upward projection. The upward projection is sized to snap fit into the groove of the support member. Each arm is separated from the interior projection by a flange of a width about equal to the width of the flats of the support member so that the arms slide over the side walls of the support member when the clip is in position.

The second type of cover member can be the same type of clip minus one upwardly extending arm and the flange associated therewith.

By use of the cover member, the ceiling grid system has substantially the same appearance as that obtained with a ceiling grid system using a notched support member, without the disadvantages resulting from use of a notched support member.

DRAWINGS

These and other features, aspects and advantages of the present invention will become better understood with regard to the following description, appended claims, and accompanying drawings where:

FIG. 1 is a perspective view of a portion of an assembled interlocking grid system comprising a support member, two opposing transverse members and a cover member according to the present invention;

FIG. 2 is a partial exploded view of the interlocking grid system of FIG. 1 at the intersection of the support member and transverse members, showing the cover member disassembled from the support member;

FIG. 3 is a sectional view of the cover member shown in FIGS. 1 and 2, taken along line 3—3 in FIG. 1; and FIG. 4 is a sectional view like that of FIG. 3 of a cover member used at the intersection of a support member with a single transverse member.

DESCRIPTION

With reference to FIGS. 1 and 2, a ceiling grid system comprises a plurality of parallel, spaced apart support members; one support member 10 is shown in FIGS. 1 and 2. The support member 10 is intersected by a pair of opposing transverse members 12, which are generally perpendicular to the support member 10. The support member 10 and the transverse members 12 are in the same plane. The support member 10 and transverse members 12 extend longitudinally and transversely, respectively, with respect to a room and are supported from an overhead superstructure of a building such as the original ceiling.

The support member 10 and transverse members 12 are rigid, and can be fabricated from a single piece of any suitable material, preferably an inexpensive, lightweight metal such as soft steel or aluminum. The support member 10 and the transverse members 12 are of a similar configuration. Each comprises a generally vertical web section 14 upstanding from a laterally projecting tile or panel supporting, load carrying support channel 16 and surmounted by a generally box-shaped, longitudinally extending, reinforcing bead or bulb 18. As shown in FIG. 1, the bulb 18 is normally hollow and substantially rectangular in transverse cross-section.

The lower support channel 16 comprises a downwardly facing groove 20, flats 22 on either side of the groove 20, vertically extending side walls 24, and upwardly facing support surfaces 25. The groove 20 comprises a downward facing interior wall 27. For decorative purposes, the downward facing interior wall 27 of the groove 20 and the flats 22 are of contrasting color. As used herein, the term "color" includes black, white, and gray. For example, the downward facing surface 27 of the groove 20 can be a black while the flats 22 can be white.

The transverse members 12 are interlocked with the support member 10 by any of a number of connecting systems, such as tongue and slot connections. A particularly preferred interlocking system is described in copending and co-assigned U.S. Patent Application Ser. No. 207,212 filed on Nov. 17, 1980 by Joseph Sharp, Ormond F. Sutter, and Phillip W. Cornwell, entitled "Locking Device for Grid System", which is incorporated herein by this reference.

At the intersection of the support member 10 and opposing transverse members 12 is provided a cover member or clip 30. The downward facing surface 32 of the clip 30 has substantially the same color as the color of the groove 20. The clip covers the downward facing surfaces of the flats 22 of the support member 10 where the support member 10 is intersected by the transverse members 12. Thus, the appearance of the clip 30 in combination with the opposing transverse members 12 is of a single continuous member.

As best shown in FIG. 3, the clip 30 in its upright position is an approximately, "W"-shaped in cross-section comprising an interior central upward projection 40 and two exterior upward projecting side arms 42. The central projection 40 is shaped like an inverted "U". It is sized to snap fit into the groove 20 of the support member. This is effected by making the upper section of the interior portion 44 of the upward projection 40 larger than the space between the flats 22 on either side of the groove 20. For example, the groove can be 0.373 inch wide, while the bottom of the interior projection 40 is 0.345 inch wide and it is 0.415 inch wide at its maximum width. When the clip 30 is installed, the upward projection 40 is resiliently deformed so that the projection 40 can fit between the flats 22 and into the groove 20, and then the upward projection springs back to retain the clip in position. The upward projection 40 is of limited height so that it does not contact surface 27 of the groove 20 when the clip is installed.

Each side arm 44 is spaced apart from the upward projection 40 by a flange of a width about equal to the width of the flats 22. In position, the flanges 41 fit over the flats 22 of the support member 12 and the side arms 42 fit over the exterior of the side walls 24 of the support member 12, exerting a force against the side walls 24. The force exerted by the side arms 42 against the side walls 24 in combination with the retention of the upward projection 40 within the groove 20 maintain the clip 30 securely in position. Further, the clip 30 is prevented from sliding within the groove 20 by the transverse members 12. As best shown in FIG. 1, the side arms 42 of the clips are sufficiently narrow that each side arm fits into the groove of an opposing transverse member 12 and is straddled by the flats 22 of a transverse member.

With reference to FIG. 4, a second type of cover member or clip 130 is used at the intersection of the support member 10 and a single transverse member 12. The downward facing surface 132 of the clip 130 has substantially the same color as the color of the groove 20 of the support member and transverse member. The clip covers the downward facing surface of the flat 22 of the suport member 10 where the support member 10 is intersected by the transverse member 12. Thus, the appearance of the clip 30 in combination with the transverse members 12 is of a single continuous member.

The clip 130 is the same as the clip 30 shown in FIGS. 1–3, minus a side arm and a flange. The clip 130 comprises an interior central upward projection 140 and a single exterior upward projecting side arm 42. The central projection 140 is shaped just like the central projection 40 of the clip 30 of FIGS. 1–3.

The side arm 144 is spaced apart from the upward projection 140 by a flange 141 of a width about equal to the width of the flats 22. In position, the flange 141 fits over one of the flats 22 of the support member 12 and the side arm 142 fits over the exterior of the side wall 24 of the support member 12, exerting a force against the side wall 24. The force exerted by the side arm 142 against a side wall 24 in combination with the retention of the upward projection 140 within the groove 20 maintain the clip 130 securely in position. Further, the clip 130 is prevented from sliding within the groove 20 by the single transverse member 12. The side arm 142 of the clip 130 is sufficiently narrow that the side arm first into the groove of the transverse member 12 and is straddled by the flats 22 of the transverse member.

The use of the cosmetic cover clips of the present invention has significant advantages compared to use of notched support members to obtain the same pleasing aesthetic effect. By eliminating the notch, the support members are substantially less expensive to manufacture. This results from the elimination of the cost of forming the notch. In addition, the membes can be manufactured on the same equipment at a substantially faster production rate. Also, eliminating the notch about doubles the load bearing capacity of the support members. Alternatively, the same load bearing capacity can be achieved by using lower gauge metal for forming the support members. For example, rather than using 24 gauge metal for a notched support member, 28 gauge metal can be used for a non-notched support member of the same load bearing capacity.

Further advantages include ease of initial installation, and easy reinstallation. The problem of aligning the support and transverse members resulting from off center notches is eliminated. Further, the grid system can be relocated easily while maintaining a grooved slot appearance at intersections.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A ceiling grid system comprising (a) a support member and (b) a pair of opposing transverse members intersecting with and abutting against the support member, the support member and transverse members each having a configuration comprising a vertical web and a lower support channel, each support channel comprising external vertical sidewalls and a downward facing groove having a downward facing interior wall of a first color, and downward facing flats on either side of the groove, the flats being of a second color, the first and second colors being different from each other, the grid system further comprising (c) means for connecting each transverse member to the support member, and (d) a resilient clip engaging the groove of the suport member and covering the flats of the support member at the location the support member is intersected by the transverse members, the clip comprising two exterior upwardly extending arms and an interior upward projection, the interior upward projection being sized to resiliently fit into the groove of the support member, each arm being spaced apart from the interior upward projection a distance about equal to the width of the flats so that the arms slide over the side walls of the support member when the clip is in position, the downwardly facing surface of the clip being of the first color so that the appearance of the two opposing transverse members in combination with the clip is that of a single continuous member.

2. A ceiling grid system comprising (a) a support member and (b) a transverse member intersecting with and abutting against the support member, the support member and transverse member each having a configuration comprising a vertical web and a lower support channel, each support channel comprising external vertical sidewalls and a downward facing groove having a downward facing interior wall of a first color, and downward facing flats on either side of the groove, one of said flats being adjacent to the flats of the transverse member, the flats being of a second color, the first and second colors being different from each other, the grid system further comprising (c) means for connecting the transverse member to the support member, and (d) a resilient clip engaging the groove of the support member and covering said one of the flats of the support member at the location the support member is intersected by the transverse member, the clip comprising an upwardly extending arm and an interior upward projection, the interior upward projection being sized to resiliently fit into the groove of the support member, the arm being spaced apart from the interior upward projection a distance about equal to the width of the flats of the support member so that the arm slides over a side wall of the support member when the clip is in position, the downwardly facing surface of the clip being of the first color so that the appearance of the transverse member in combination with the clip is that of a single continuous member.

* * * * *